US005667715A

United States Patent [19]

Foister

[11] Patent Number: 5,667,715

[45] Date of Patent: Sep. 16, 1997

[54] MAGNETORHEOLOGICAL FLUIDS

[75] Inventor: Robert Thomas Foister, Rochester Hills, Mich.

[73] Assignee: General Motors Corporation, Detroit, Mich.

[21] Appl. No.: 629,249

[22] Filed: Apr. 8, 1996

[51] Int. Cl.[6] ..... H01F 1/28

[52] U.S. Cl. ..... 252/62.52; 252/62.54

[58] Field of Search ..... 252/62.52, 62.54

[56] References Cited

U.S. PATENT DOCUMENTS

| | | | |
|---|---|---|---|
| 4,957,644 | 9/1990 | Price et al. | 252/62.52 |
| 4,992,190 | 2/1991 | Shtarkman | 252/62.52 |
| 5,167,850 | 12/1992 | Shtarkman | 252/62.52 |
| 5,276,623 | 1/1994 | Wolfe | 364/424.05 |
| 5,277,281 | 1/1994 | Carlson et al. | 188/267 |
| 5,284,330 | 2/1994 | Carlson et al. | 267/140.14 |
| 5,354,488 | 10/1994 | Shtarkman et al. | 252/62.56 |
| 5,382,373 | 1/1995 | Carlson et al. | 252/62.55 |
| 5,390,121 | 2/1995 | Wolfe | 364/424.05 |
| 5,396,973 | 3/1995 | Schwemmer et al. | 188/299 |
| 5,398,917 | 3/1995 | Carlson et al. | 267/140.14 |
| 5,492,312 | 2/1996 | Carlson | 267/140.14 |
| 5,525,249 | 6/1996 | Kordonsky et al. | 252/62.52 |

OTHER PUBLICATIONS

Chang et al, "Effect of Particle Size Distributions on the Rheology of Concentrated Bimodal Suspensions," *Journal of Rheology*, 38(1), Jan./Feb. 1994, pp. 85–98.

Lemaire et al, "Influence of the Particle Size on the Rheology of Magnetorheological Fluids," *Journal of Rheology*, 39(5), Sep./Oct. 1995, pp. 1011–1020.

Poslinski et al, "Rheological Behavior of Filled Polymeric Systems II. The Effect of a Bimodal Size Distribution of Particulates," *Journal of Rheology*, 32(8), 1988, pp. 751–771.

*Primary Examiner*—Melissa Bonner
*Attorney, Agent, or Firm*—George A. Grove

[57] ABSTRACT

A significant increase in the yield stress of a magnetorheological fluid can be obtained at a given volume fraction of solid magnetic particles by employing as the particulate component a mixture of a first component of relatively large particles and a second component of relatively small particles such that the mean diameter of the large particles is at least 5 times the mean diameter of the small particles. The mixture of large and small particles provides a substantial increase in the yield stress without an increase in the viscosity of the mixture in the absence of a magnetic field.

12 Claims, 5 Drawing Sheets

MAGNETORHEOLOGICAL FLUIDS

This invention pertains to fluid materials which exhibit substantial increases in flow resistance when exposed to a suitable magnetic field. Such fluids are sometimes called magnetorheological fluids because of the dramatic effect of the magnetic field on the rheological properties of the fluid. More specifically, this invention relates to certain low coercivity ferromagnetic particle specifications for providing a suitably low viscosity in the fluid in the absence of an applied magnetic field and an increased yield stress when the fluid is in the presence of a magnetic field.

BACKGROUND OF THE INVENTION

Magnetorheological (MR) fluids are substances that exhibit an ability to change their flow characteristics by several orders of magnitude and in times on the order of milliseconds under the influence of an applied magnetic field. An analogous class of fluids are the electrorheological (ER) fluids which exhibit a like ability to change their flow or rheological characteristics under the influence of an applied electric field. In both instances, these induced rheological changes are completely reversible. The utility of these materials is that suitably configured electromechanical actuators which use magnetorheological or electrorheological fluids can act as a rapidly responding active interface between computer-based sensing or controls and a desired mechanical output. With respect to automotive applications, such materials are seen as a useful working media in shock absorbers, for controllable suspension systems, vibration dampers in controllable powertrain and engine mounts and in numerous electronically controlled force/torque transfer (clutch) devices.

MR fluids are noncolloidal suspensions of finely divided (typically one to 100 micron diameter) low coercivity, magnetizable solids such as iron, nickel, cobalt, and their magnetic alloys dispersed in a base carrier liquid such as a mineral oil, synthetic hydrocarbon, water, silicone oil, esterified fatty acid or other suitable organic liquid. MR fluids have an acceptably low viscosity in the absence of a magnetic field but display large increases in their dynamic yield stress when they are subjected to a magnetic field of, e.g., about one Tesla. At the present state of development, MR fluids appear to offer significant advantages over ER fluids, particularly for automotive applications, because the MR fluids are less sensitive to common contaminants found in such environments, and they display greater differences in rheological properties in the presence of a modest applied field.

Since MR fluids contain noncolloidal solid particles which are often seven to eight times more dense than the liquid phase in which they are suspended, suitable dispersions of the particles in the fluid phase must be prepared so that the particles do not settle appreciably upon standing nor do they irreversibly coagulate to form aggregates. Examples of suitable magnetorheological fluids are illustrated, for example, in U.S. Pat. Nos. 4,957,644 issued Sep. 18, 1990, entitled "Magnetically Controllable Couplings Containing Ferrofluids"; 4,992,190 issued Feb. 12, 1991, entitled "Fluid Responsive to a Magnetic Field"; 5,167,850 issued Dec. 1, 1992, entitled "Fluid Responsive to a Magnetic Field"; 5,354,488 issued Oct. 11, 1994, entitled "Fluid Responsive to a Magnetic Field"; and 5,382,373 issued Jan. 17, 1995, entitled "Magnetotheological Particles Based on Alloy Particles".

As suggested in the above patents and elsewhere, a typical MR fluid in the absence of a magnetic field has a readily measurable viscosity that is a function of its vehicle and particle composition, particle size, the particle loading, temperature and the like. However, in the presence of an applied magnetic field, the suspended particles appear to align or cluster and the fluid drastically thickens or gels. Its effective viscosity then is very high and a larger force, termed a yield stress, is required to promote flow in the fluid.

Given a stable noncoagulating suspension, the problem in formulating useful MR fluids as working media in actuators such as shock absorbers, powertrain mounts, starting clutches and the like can be stated as follows. The off-state viscosity of the fluid (that is, the viscosity with no magnetic field applied) is to be minimized or, alternatively, fixed at a constant acceptable value while the on-state (magnetic field applied) yield stress of the fluid is to be maximized or fixed at an acceptably constant value. Thus, the off-state viscosity and the on-state yield stress are both important because they both contribute to the magnitude of a magnetorheological effect. The difference between such off-state viscosity and on-state yield stress may be conveniently expressed as a "turn-up ratio". Turn-up ratio is defined as the ratio of the force or torque output generated by the magnetically activated MR fluid divided by the force or torque output for the same fluid in the unactivated or off-state. In MR fluids, the maximum force or torque "on" is controlled by the yield stress while the minimum force or torque "off" is controlled by the viscosity. The object in designing controllable fluid actuators is generally to maximize the turn-up ratio under given operating conditions. It is an object of the present invention to manipulate the material or fluid composition variables so as to maximize the turn-up ratio of the fluid.

SUMMARY OF THE INVENTION

Certain aspects of prior art MR fluids such as those described in the above-identified patents will illustrate the benefits and advantages of the subject invention. A first observation in characterizing MR fluids is that for any applied magnetic field (or equivalently for any given magnetic flux density), the magnetically induced yield stress increases with the solid particle volume fraction. This is the most obvious and most widely employed compositional variable used to increase the MR effect. This is illustrated in FIG. 1, which is a graph recording the yield stress in pounds per square inch of suspensions of pure iron microspheres dispersed in a polyalphaolefin liquid vehicle at increasing volume fractions. The strength of the magnetic field applied is 1.0 Tesla. It is seen that the yield stress increases gradually from about 5 psi at a volume fraction of iron microspheres of 0.1 to a value of about 18 psi at a volume fraction of 0.55. In order to double the yield stress from 5 psi at a volume fraction of 0.1, it is necessary to increase the volume fraction of microspheres to about 0.45. However, as the volume fraction of solid increases in the on-state, the viscosity in the off-state increases dramatically and much more rapidly as well. This is illustrated in FIG. 2. FIG. 2 is a semilog plot of viscosity in centipoise versus the volume fraction of the same suspension of iron microspheres. It is seen that a small increase in the volume fraction of microspheres results in a dramatic increase in the viscosity of the fluid in the off-state. Thus, while the yield stress may be doubled by increasing the volume fraction from 0.1 to 0.45, the viscosity increases from about 15 centipoise to over 200 centipoise. This means that the turn-up ratio (shear stress "on" divided by shear stress "off") at 1.0 Tesla actually decreases by more than a factor of 10.

In terms of basic rheological properties, the turn-up ratio is defined as the ratio of the shear stress at a given flux density to the shear stress at zero flux density. At appreciable flux densities, for example of the order of 1.0 Tesla, the shear stress "on" is given by the yield stress, while in the off state, the shear stress is essentially the viscosity times the shear rate. With reference to FIG. 1, for a volume fraction of 0.55, at 1.0 Tesla the yield stress is 18 psi. This fluid has a viscosity of 2000 cP, which, if subjected to a shear rate of 1000 reciprocal seconds (as in a rheometer), gives an off-state shear stress of approximately 0.3 psi (where 1 cP=$1.45\times10^{-7}$ lbf s/m$^2$). Thus, the turn-up ratio at 1.0 Tesla is (18/0.3), or 60. However, in a device in which the shear rate is higher, e.g., 30,000 seconds$^{-1}$, the turn-up ratio is then only 2.0.

The observation that the on and off-states of MR fluids have been coupled in the sense that any attempt to maximize the on-state yield stress by increasing the solid volume fraction will carry a great penalty in turn-up ratio because the viscosity in the off-state will increase at the same time, as illustrated by the above example. This has been generally recognized in the prior art and has been stated explicitly in, for example, U.S. Pat. No. 5,382,373 at column 3. For a given type of magnetizable solid, experience has identified no other variable such as fluid type, solid surface treatment, anti-settling agent or the like which has anything like the effect of volume fraction on the yield stress of the MR fluid. Therefore, it is necessary to find a means of decoupling the on-state yield stress and the off-state viscosity and their mutual dependence on solid volume fraction.

In accordance with the subject invention, this decoupling is accomplished by using a solid with a "bimodal" distribution of particle sizes instead of a monomodal distribution to minimize the viscosity at a constant volume fraction. By "bimodal" is meant that the population of solid ferromagnetic particles employed in the fluid possess two distinct maxima in their size or diameter and that the maxima differ as follows.

Preferably, the particles are spherical or generally spherical such as are produced by a decomposition of iron pentacarbonyl or atomization of molten metals or precursors of molten metals that may be reduced to the metals in the form of spherical metal particles. In accordance with the practice of the invention, such two different size populations of particles are selected—a small diameter size and a large diameter size. The large diameter particle group will have a mean diameter size with a standard deviation no greater than about two-thirds of said mean size. Likewise, the smaller particle group will have a small mean diameter size with a standard deviation no greater than about two-thirds of that mean diameter value. Preferably, the small particles are at least one micron in diameter so that they are suspended and function as magnetorheological particles. The practical upper limit on the size is about 100 microns since particles of greater size usually are not spherical in configuration but tend to be agglomerations of other shapes. However, for the practice of the invention the mean diameter or most common size of the large particle group preferably is five to ten times the mean diameter or most common particle size in the small particle group. The weight ratio of the two groups shall be within 0.1 to 0.9. The composition of the large and small particle groups may be the same or different. Carbonyl iron particles are inexpensive. They typically have a spherical configuration and work well for both the small and large particle groups.

It has been found that the off-state viscosity of a given MR fluid formulation with a constant volume fraction of MR particles depends on the fraction of the small particles in the bimodal distribution. However, the magnetic characteristics (such as permeability) of the MR fluids do not depend on the particle size distribution, only on the volume fraction. Accordingly, it is possible to obtain a desired yield stress for an MR fluid based on the volume fraction of bimodal particle population, but the off-state viscosity can be reduced by employing a suitable fraction of the small particles.

For a wide range of MR fluid compositions, the turn-up ratio can be managed by selecting the proportions and relative sizes of the bimodal particle size materials used in the fluid. These properties are independent of the composition of the liquid or vehicle phase so long as the fluid is truly an MR fluid, that is, the solids are noncolloidal in nature and are simply suspended in the vehicle. The viscosity contribution and the yield stress contribution of the particles can be controlled within a wide range by controlling the respective fractions of the small particles and the large particles in the bimodal size distribution families. For example, in the case of the pure iron microspheres a significant improvement in turn-up ratio is realized with a bimodal formulation of 75% by volume large particles-25% small particles where the arithmetic mean diameter of the large particles is seven to eight times as large as the mean diameter of the small particles.

These and other objects and advantages of the invention will become more apparent from a detailed description thereof which follows. Reference will be made to the drawings in which:

DESCRIPTION OF PREFERRED EMBODIMENTS

Figure 1:
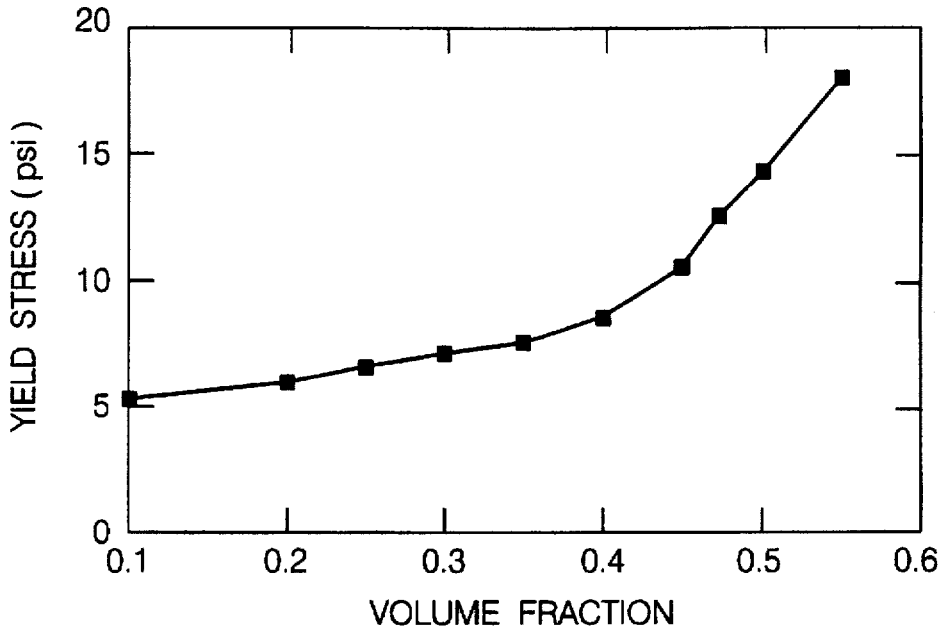
FIG. 1 is a graph of yield stress (psi) versus volume fraction of monomodal size distribution carbonyl iron particles in an MR fluid mixture under a magnetic flux density of 1 Tesla.

In general the practice of the invention is widely applicable to MR fluid components. For example, the solids suitable for use in the fluids are magnetizable ferromagnetic, low coercivity (i.e., little or no residual magnetism when the magnetic field is removed), finely divided particles of iron, nickel, cobalt, iron-nickel alloys, iron-cobalt alloys, iron-silicon alloys and the like which are spherical or nearly spherical in shape and have a diameter in the range of about 1 to 100 microns. Since the particles are employed in noncolloidal suspensions, it is preferred that the particles be at the small end of the suitable range, preferably in the range of 1 to 10 microns in nominal diameter or particle size. The particles used in MR fluids are larger and compositionally different than the particles that are used in "ferrofluids" which are colloidal suspensions of, for example, very fine particles of iron oxide having diameters in the 10 to 100 nanometers range. Ferrofluids operate by a different mechanism from MR fluids. MR fluids are suspensions of solid particles which tend to be aligned or clustered in a magnetic field and drastically increase the effective viscosity or flowability of the fluid.

This invention is also applicable to MR fluids that utilize any suitable liquid vehicle. The liquid or fluid carrier phase may be any material which can be used to suspend the particles but does not otherwise react with the MR particles. Such fluids include but are not limited to water, hydrocarbon oils, other mineral oils, esters of fatty acids, other organic liquids, polydimethylsiloxanes and the like. As will be illustrated below, particularly suitable and inexpensive fluids are relatively low molecular weight hydrocarbon polymer liquids as well as suitable esters of fatty acids that are liquid at the operating temperature of the intended MR device and have suitable viscosities for the off condition as well as for suspension of the MR particles.

Demonstration of the Effect of Bimodal Particles Sizes in MR Fluids

A number of magnetizable solids were initially tested, including various alloys of iron and nickel, iron and silicon, and pure (99.9%) iron. A preferred material is the particulate iron microspheres known as carbonyl iron. Carbonyl iron is made by the thermal decomposition of iron pentacarbonyl. Two different iron carbonyl products will be used in this description. One is a product designated R-1470, manufactured by ISP Technologies, Inc. It is a relatively soft, spherical powder made from iron pentacarbonyl and then reduced in a nitrogen atmosphere. The manufacturer listed the mean particle diameter as seven microns for R-1470 and the true density as 7.78 g/cc. R-1470 is the "large" particulate iron material referred to in this specification. A second ISP product designated S-3700 was a harder, smaller particle which was made by the thermal decomposition of iron pentacarbonyl but not subjected to a reduction step. The listed mean particle size for S-3700 was 3 to 6 microns, and the true density was given as 7.65 g/cc.

Figure 7:
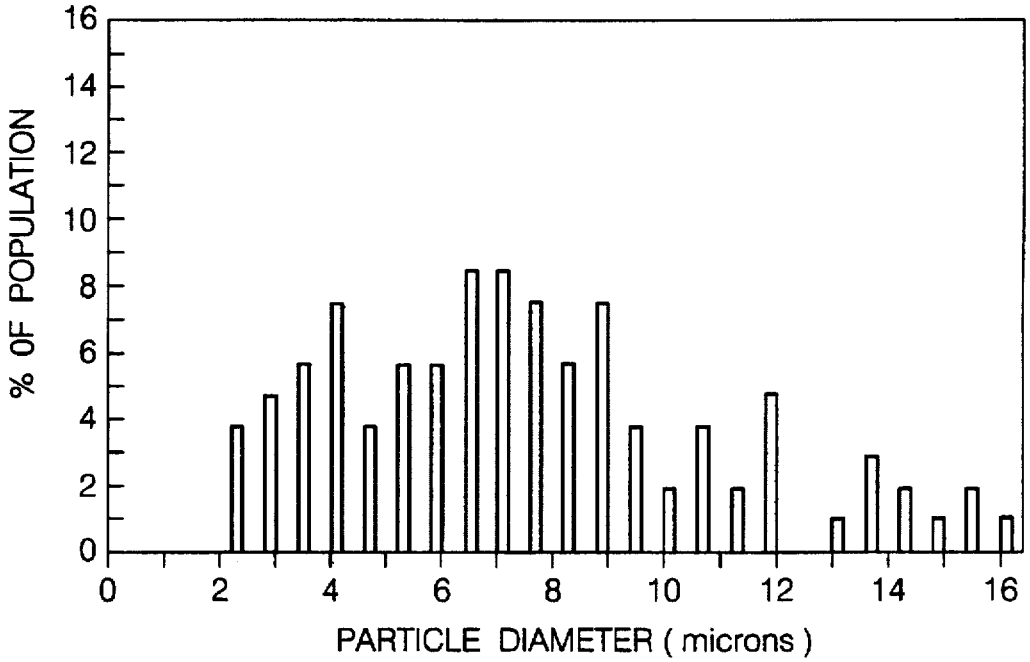
FIG. 7 is a plot showing the diameter distribution for a large particle component of an MR fluid. The graph plots percent of population versus particle diameter.
Figure 8:
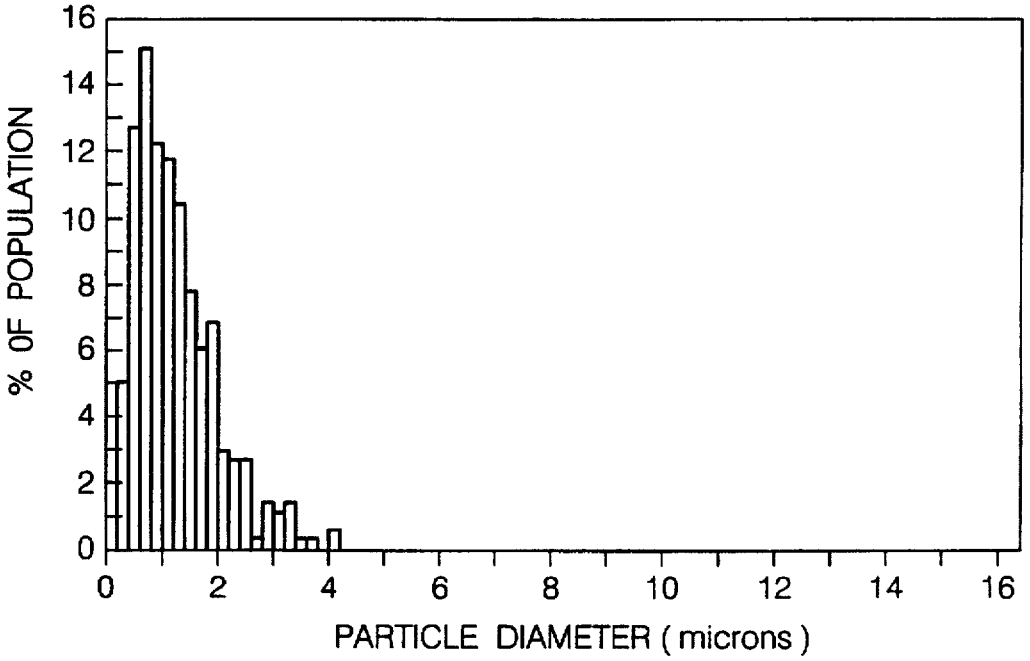
FIG. 8 is a plot of the diameter distributions for a small particle component of an MR fluid.

Microscopic analysis of R-1470 revealed that this iron particle product consisted of a range of particle sizes clustered about a mean particle diameter of 7.9 microns with a standard deviation of 3.5 microns. The results of the particle size analysis are depicted in FIG. 7. A like microscopic analysis of S-3700 revealed that it had a mean particle diameter of 1.25 microns with a standard deviation of 0.71 microns. The results of the analysis of S-3700 are depicted in FIG. 8. A suitable screen analysis could also be employed. Preferably, the standard deviation of the diameters of the spherical particles of each group is no more than about two-thirds (e.g., 65% to 75%) of the value of the mean diameter of the respective group.

In characterizing the MR fluids that are prepared throughout the remainder of this specification, the actual microscopic analysis particle size measurements are used. The ratio of large particle mean diameter to small particle mean diameter, 7.9 microns/1.25 microns, is thus 6.3. It is further preferred, especially when the mean diameters of the two magnetic particle groups are thus within the preferred range of 1 to 10 microns, that the mean diameter of the larger particles be greater than seven microns and that the mean diameter of the smaller particles be less than three microns.

The MR fluids used in the studies of volume fraction of particulate material in the fluid versus viscosity and yield stress that are summarized in FIGS. 1 and 2 referred to above were prepared as follows. The MR vehicle used was a hydrogenated polyalphaolefin (PAO) base fluid, designated SHF 21, manufactured by Mobil Chemical Company. The material is a homopolymer of 1-decene which is hydrogenated. It is a paraffin-type hydrocarbon and has a specific gravity of 0.82 at 15.6° C. It is a colorless, odorless liquid with a boiling range of 375° C. to 505° C. In order to suspend the small iron particles in the polyalphaolefin, a miscible polymeric gel material that included about nine parts of a paraffinic hydrocarbon gel with the consistency of Vaseline and one part of a surfactant was thoroughly mixed with PAO base fluid. Preweighed amounts of the PAO fluid base and the polymeric gel (33% of the weight of the PAO) were mixed under high shear conditions for approximately 10 minutes. The resultant mixture was degassed and under vacuum for about 5 minutes, and then preweighed solid iron microspheres, the R-1470 product, were added in weighed amounts to form the several MR fluid volume fraction mixtures (0.1, 0.2 . . . 0.5, 0.55), whose data is summarized in FIGS. 1 and 2. The several different fluids were made up by adding the preweighed solid with mixing for six to eight hours, and the fluids were then again degassed before testing.

Figure 2:
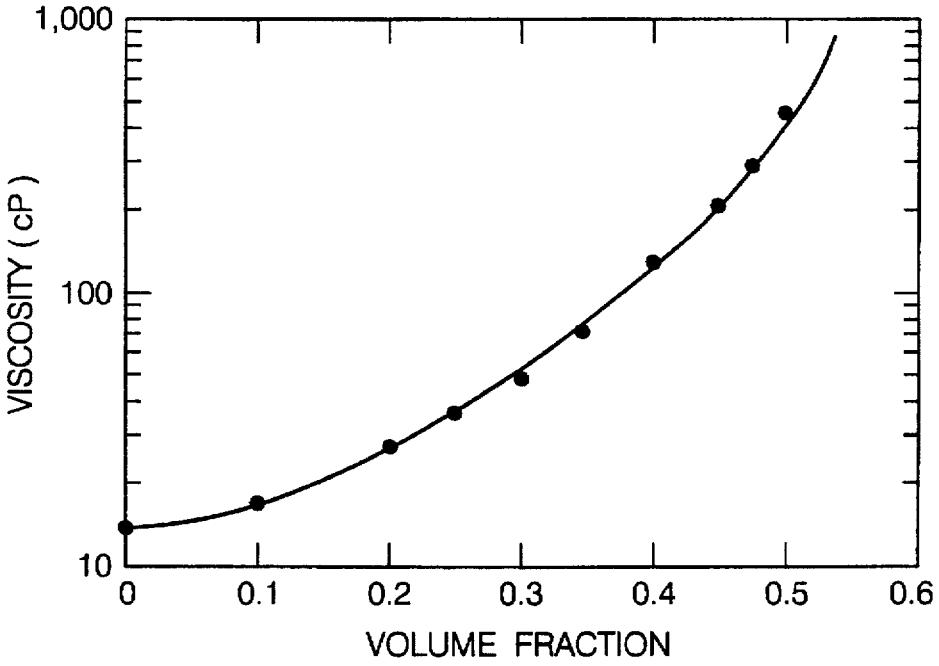
FIG. 2 is a graph of the viscosity versus volume fraction of carbonyl iron microspheres for the same family of MR fluids whose yield stresses are depicted in FIG. 1.

The effect of increasing volume fraction of the iron carbonyl microspheres on the viscosity of the PAO vehicle base MR fluids is seen in FIG. 2. The effect of volume fraction on yield stress at a magnetic field density of 1 Tesla is seen in FIG. 1. As observed above, while the increase in the volume fraction of the iron carbonyl particles produces an increase in the yield stress of the MR fluids, the increase in viscosity occurs at a much higher rate. Thus, in order to obtain a suitably high yield stress for the suitable functioning of a magnetorheological fluid device actuator, one must tolerate a relatively high viscosity when the material is in the turned off condition. In other words, the turn-up ratio for such materials that contain particles of a single effective particle size could result in serious compromises in the design of the actuators.

Effect of Particles with Bimodal Size Distribution on RM Fluid Properties

A series of MR fluids based on the PAO vehicle/polymeric gel dispersing material described above were prepared with a 0.55 volume fraction of iron carbonyl particles. A "large" particle size iron carbonyl, the R-1470 material, and "small" particle size iron carbonyl, the S-3700 material, were used to prepare the mixtures. A large particle fluid (zero fraction small particle) was used as the base line, which is the material whose yield stress value at a field strength of one Tesla in the on-state as seen in FIG. 1 is about 18 psi and whose viscosity (off-state) is just off the chart of FIG. 1 but was determined to be 2000 centipoise. As illustrated above, the turn-up ratio of this fluid at a shear rate of 1000 seconds$^{-1}$ is 60.

Figure 3:
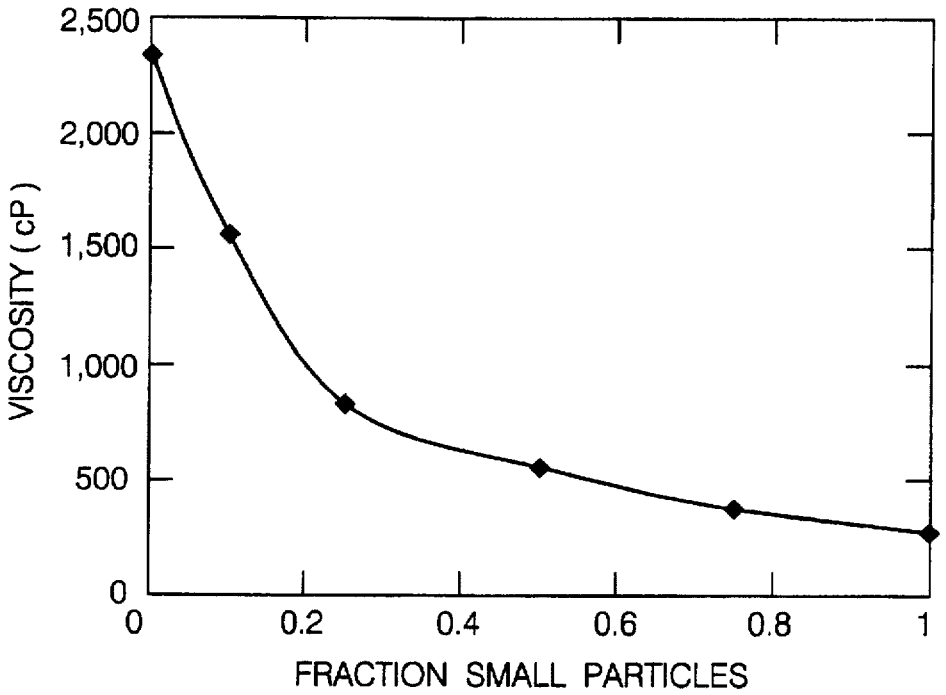
FIG. 3 is a graph of viscosity in centipoise versus the fraction of small particles of an MR fluid containing 55 percent by volume solids.

Bimodal mixture fluids containing 10, 23, 45 and 67 percent of total particle content small particles were prepared. A monomodal fluid of 100% small particles was also prepared. Instead of percent the small particle to total particle relation is sometimes expressed as 'volume fraction' of small particles. The effect of the combination of the two particle sizes on viscosity is summarized and seen in FIG. 3. While the overall volume fraction of iron carbonyl particles in the PAO base fluid remains the same, 55 volume percent solid, the viscosity of the fluid at 40° C. drops from 2300 centipoise to about 250 centipoise as the proportion of small particles (S-3700 microspheres) increased.

Figure 4:
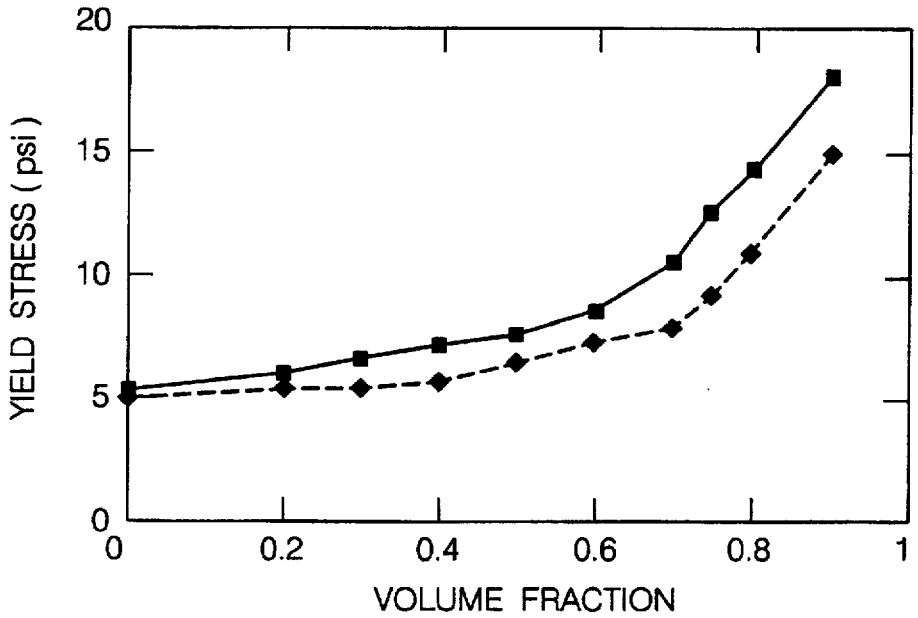
FIG. 4 is a graph of yield stress in psi versus volume fraction of particles in the MR fluid at 1 Tesla for monomodal suspensions of large (dark square) and small (dark diamond) particles.

FIG. 4 shows the effect of particle size on the yield stress of MR fluids based on the PAO fluid and the same volume fractions of single particle size R-1470 (dark squares) or S-3700 (dark diamonds) particle type mixtures. It is seen that while the large particles in a monomodal particle size mixture gives slightly higher yield stresses in the fluid at a magnetic field density of 1 Tesla, there is not much difference in yield stress as compared to the small particle fluids at the same volume fraction of particles. Thus, in summarizing the information obtained from FIGS. 3 and 4, it is seen that the mixing of a small particle size family with a large particle size family of the same composition reduces viscosity for the off-state of a magnetorheological device but would apparently have little effect on the yield stress.

Figure 5:
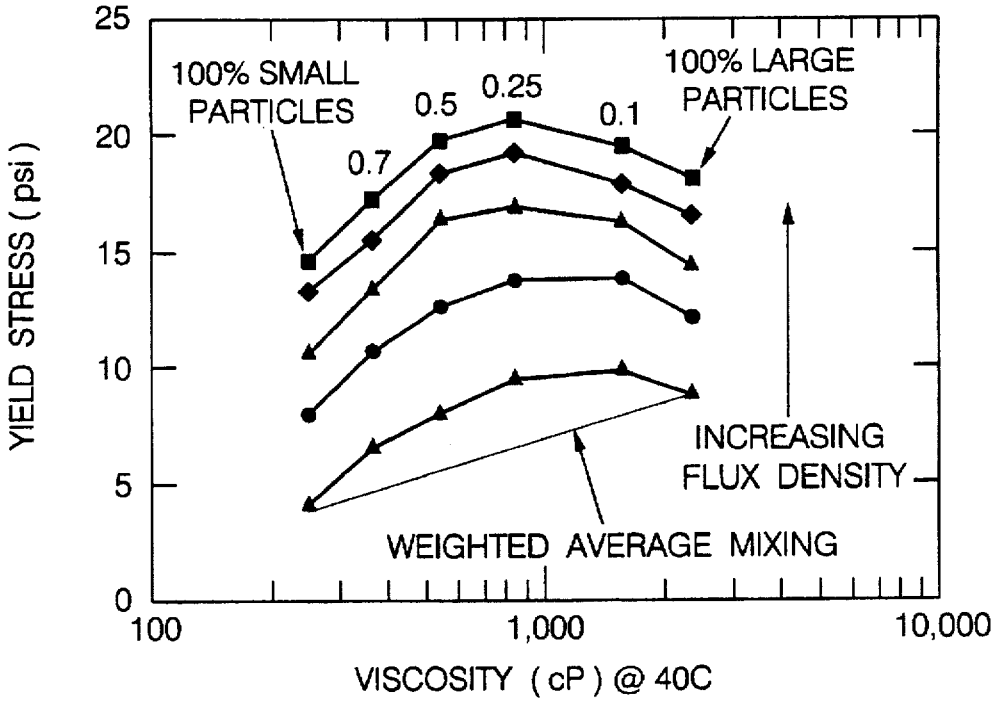
FIG. 5 is a graph of yield stress (psi) versus viscosity (centipoise) for large particles, small particles and mixtures of large and small particles in a 55 volume percent total solids MR fluid at increasing magnetic flux density.
Figure 6:
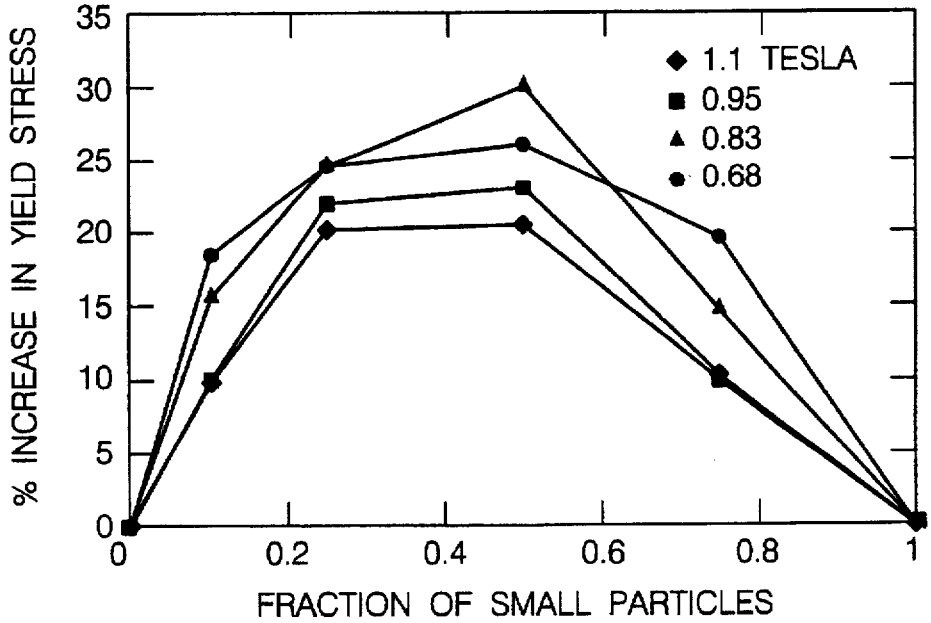
FIG. 6 is a graph of percent increase in yield stress versus volume fraction of small particles.

However, a surprising result of preparing MR fluids with a bimodal mixture of large and small particles is that the mixture provides a substantially enhanced effect on the yield stress of the fluid in the on-state. The yield stress of bimodal mixtures is much higher than the yield stress for the monomodal suspension of large particles at the same particle content in the fluid. This is clearly shown in FIG. 5. In FIG. 5, a series of MR fluid suspensions were prepared, all at a total particle content of 55% by volume. However, the percentage of small particles in the mixtures was increased from substantially zero to 100% (viewing right to left for each plotted line), and the fluids were subjected to increasing flux density (i.e., 0.49, 0.68, 0.83, 0.95 and 1.06 Tesla, respectively) as the viewer's eye travels up the graph in FIG. 5. The expected yield stress from a weighted average mixing effect is drawn as a straight line in the lower curve. However, it is seen in each instance that the actual yield stress curve for increasing amounts of the smaller particles is much greater than the value expected from a weighted average. In the case of the mixtures of the R-1470 iron microspheres and the S-3700 microspheres, the optimum yield stress was for a mixture that was 0.25 weight fraction of the small sphere and 0.75 weight fraction of the large spheres. FIG. 6, utilizing data from FIG. 5, shows the percent increase in observed yield stress above the weighted average value for the small particle/large particle mixtures whose data is summarized in FIG. 5.

One can quantify an advantage of this invention by considering the above examples and referring to FIG. 5. With the bimodal distribution described using 25 percent small particles at a total particle volume fraction of 0.55, the yield stress at 1.06 Tesla is 20 psi, but the viscosity is only 800 cP. This fluid gives a turn-up ratio of 167 at a shear rate of 1000 seconds$^{-1}$ and of 5.7 at 30,000 seconds$^{-1}$. These values represent an increase over the monomodal, large particle only case of more than 2.7 times.

Thus, a fundamental aspect of this invention is the discovery that for a given total particle volume fraction, the employment of a suitable mixture of two family particle sizes markedly increases the on-state yield stress in an MR fluid without a concomitant increase in the off-state viscosity of the fluid. Thus, by employing bimodal particle size families as the magnetic particle component of MR fluids, it is possible to substantially increase the turn-up ratio of the fluid for a given off-state viscosity level.

Other MR Fluids

This example illustrates other practices for suspending the magnetic powder in the MR fluid vehicle.

Anticoagulation of Particles

It may be useful to coat the magnetic particles, especially the larger size particles (here, the R-1470 iron microspheres) with a surfactant to reduce the tendency for coagulation of the particles during utilization of MR fluids. An example of this practice is as follows. A tallow-amine surfactant (Ethomene T-15, manufactured by Akzo Chemical Company, Inc.) was selected. The surfactant is first dissolved in the MR vehicle, e.g., PAO (SHF 21), with a surfactant concentration in the vehicle equal to 10% of the weight of the iron to be treated. The larger particle size iron powder, R-1470, is then mixed with the surfactant solution for eight hours, after which the mixture is filtered and the surfactant coated iron particles recovered for later use in formulating MR fluids. To assure accurate volume fraction determination of the solid particles, residual PAO in the filtered iron is determined by a thermogravimetric analysis as a percentage by weight for each batch of the treated iron microspheres. A treatment of this type with a surfactant on the larger particle size is found to minimize or eliminate coagulation and clumping of iron particles in the MR fluids. The pretreated large particles and the nonpretreated small particles are then combined in predetermined desired proportions to form bimodal distributions as described above.

Other MR Vehicles

PAO is a suitable base fluid for many MR applications in accordance with this invention. However, the polyalkylolefin does not have suitable lubricant properties for some applications. There are many applications where it is desired that the MR fluid have good lubrication properties. Therefore, PAO may be used in mixture with known lubricant fluids such as liquid alkyl ester-type fatty acids. Alternatively, such esterified fatty acids or other lubricant-type fluids may be employed with no PAO present. Examples of other suitable MR fluids include dioctyl sebacate and alkyl esters of tall oil type fatty acids. Methyl esters and 2-ethyl hexyl esters have been used. Saturated fatty acids with various esters including polyol esters, glycol esters and butyl and 2-ethyl hexyl esters have been tried and found suitable for use with bimodal magnetic particles in the practice of the subject invention. Mineral oils and silicone fluids, e.g., Dow Chemical 200 Silicon Fluids have been used with bimodal particles as MR fluids.

The phenomenon and advantage that is provided by the use of a bimodal particle size distribution magnetic particle is substantially independent of the fluid vehicle, and the benefits of the invention can be obtained by using any liquid that does not react chemically with the magnetic particles but serves as the suspending medium.

Different fluid media may require different dispersing and stabilization strategies. It is recognized that appropriate fumed silicas may be used as a thixotrope in the fluid. A high shear dispersion of the ultrafine silica particles into the vehicle provides a thixotropic medium for stabilizing the dispersion of the magnetic particles. The selection of the suitable silica depends on the chemical nature of the MR fluid chosen. For example, PAO is a nonpolar liquid polymer, and it requires a hydrophilic fumed silica. Cab-O-Sil M5 (Cabot Corporation) is such a silica and is suitably used in amounts of 5 to 10 parts by weight of the PAO. Other lubricants such as the esterified fatty acids are quite polar, and they require a hydrophobic fumed silica such as Cab-O-Sil TS720 to provide suitable thixotropy.

In the preparation, then, of the MR fluids, the liquid vehicle and the fumed silica are mixed under high shear conditions for approximately 10 minutes. The resultant thixotropic fluid is degassed for 5 to 10 minutes and then pretreated with surfactant. Solid magnetic particles are added and the final fluid is mixed for six to eight hours and then degassed once again before use.

In accordance with the subject invention, it is preferred that the magnetic particles be a mixture of spherical particles in the range of 1 to 100 microns in diameter with two distinct particle size members present, one a relatively large particle size that is 5 to 10 times the mean diameter of the relatively small particle size component.

An example of a lubricating MR system is formulated as follows.

The magnetic particle constituent consists of 25% by weight S-3700 carbonyl iron and 75% by weight R-1470 carbonyl iron treated with the amine tallow oil surfactant. The fluid vehicle was a mixture of 50% by volume PAO (SHF 21), 25% by volume dioctyl sebacate (Union Camp) and 25% by volume Union Camp Uniflex 171 methyl esters of tall oil fatty acids. Suspended in the fluid was 7 weight percent of fumed silica, Cab-O-Sil M5, based on the weight of the fluid. Various MR fluids varying in volume fraction of total iron carbonyl particles were prepared, but each fluid contained the 25% small particle-75% large particle mixture.

Figure 9:
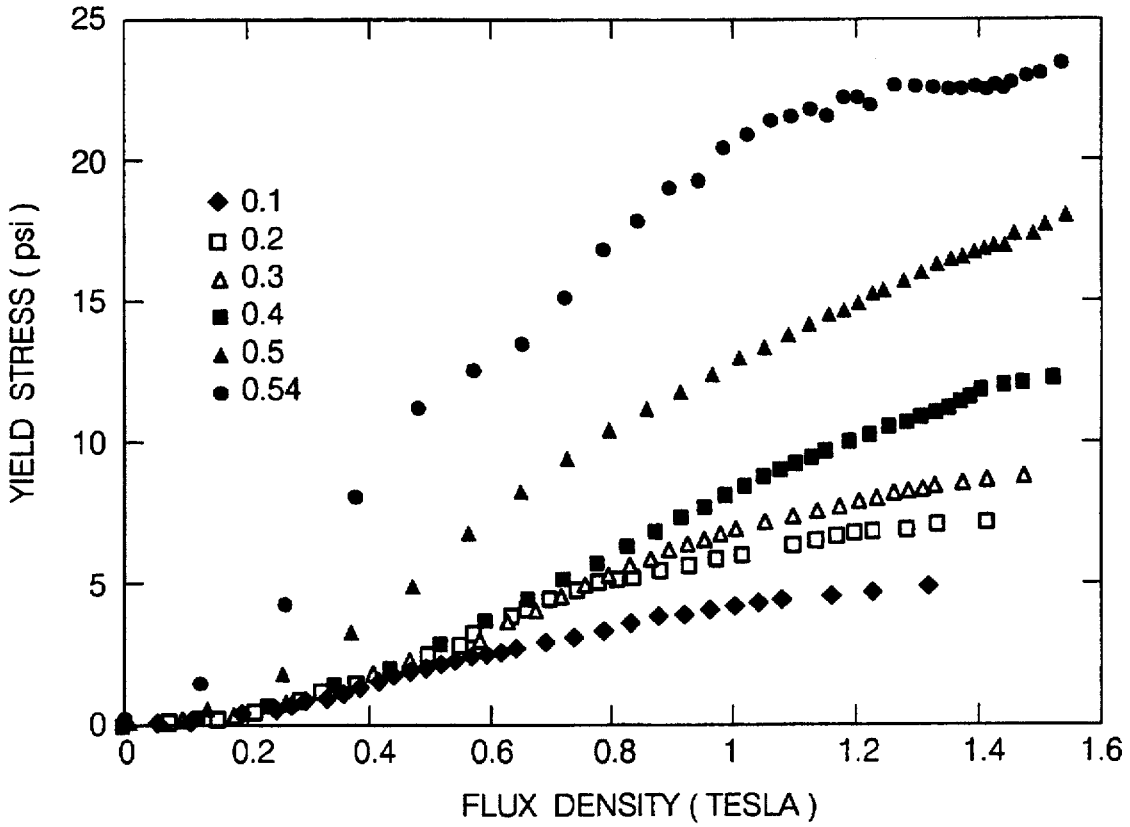
FIG. 9 is a plot of yield stress versus flux density for various volume fraction iron particles (0.1 to 0.54) MR fluids of the same families whose properties are depicted in FIG. 10.
Figure 10:
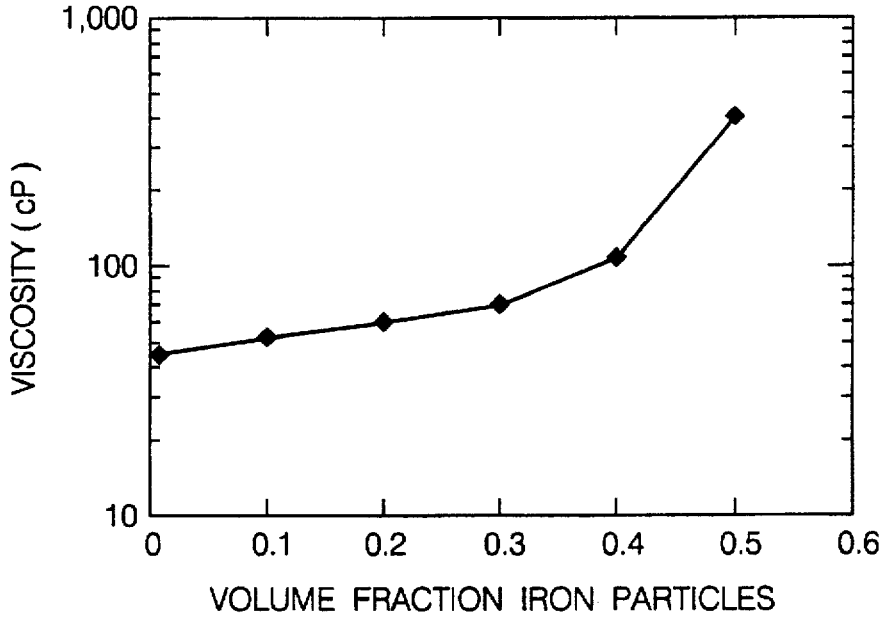
FIG. 10 is a plot of viscosity (centipoise) versus volume fraction iron particles for a bimodal distribution MR fluid of the subject invention.

The magnetorheological characteristics of this self-lubricating MR fluid are summarized and illustrated in FIGS. 9 and 10. FIG. 10 shows the viscosity of the mixtures with increasing volume fraction of the bimodal iron particles. FIG. 9 shows the yield stress with increasing flux density in Tesla for the various volume fraction iron particles in the above-specified MR fluids. It is seen that this family of fluids provides very high yield stresses while the viscosity in the off-state does not exceed 400 centipoise.

While this invention has been described in terms of certain preferred embodiments thereof, it will be appreciated that other forms could readily be adapted by one skilled in the art. Accordingly, the scope of this invention is to be considered limited only by the following claims.

What is claimed is:

1. A magnetorheological fluid comprising low coercivity, generally spherical magnetic particles dispersed in a liquid vehicle, said particles consisting essentially of a first group of particles having a first range of diameter sizes with a first mean diameter having a standard deviation no greater than about two-thirds of the value of said first mean diameter and a second group of particles with a second range of diameter sizes and a second mean diameter having a standard deviation no greater than about two-thirds of said second mean diameter, such that the major portion of all particle sizes fall within the range of one to 100 microns and the weight ratio of each of said first group and said second group to the total weight of said magnetic particles is in the range of 0.1 to 0.9, and the ratio of said first mean diameter to said second mean diameter is five to ten.

2. A fluid as recited in claim 1 in which said first and second groups of particles comprise one or more metals selected from the group consisting of iron, nickel and cobalt.

3. A fluid as recited in claim 1 in which said first and second groups of particles comprise carbonyl iron particles having a mean diameter in the range of one to ten microns.

4. A fluid as recited in claim 1 in which said first and second groups of particles are of the same composition.

5. A fluid as recited in claim 1 in which said particles are dispersed in a polyalphaolefin containing liquid.

6. A fluid as recited in claim 1 in which said particles are dispersed in an esterified fatty acid containing liquid.

7. A fluid that is pourable at ambient conditions in the absence of an applied magnetic field but has a yield stress in excess of 10 psi in an applied magnetic field one Tesla or more, said fluid comprising generally spherical, low coercivity, ferromagnetic or paramagnetic metal particles of particle sizes substantially in the range of one micron to 100 microns dispersed in a liquid vehicle with a dispersing agent, said particles consisting essentially of a first group of particles having a first range of diameter sizes with a first mean diameter having a standard deviation no greater than about two-thirds of the value of said first mean diameter and a second group of particles with a second range of diameter sizes and a second mean diameter having a standard deviation no greater than about two-thirds of the value of said mean diameter such that the ratio of said first mean diameter to said second mean diameter is five to ten and the weight ratio of each of said first group and said second group to the total weight of spherical metal particles is in the range of 0.1 to 0.9.

8. A fluid as recited in claim 7 where said particles are carbonyl iron particles and said first mean diameter is greater then seven microns and said second mean diameter is less than three microns.

9. A fluid as recited in claim 1 in which at least said first group of particles comprises surfactant coated carbonyl iron particles.

10. A fluid as recited in claim 1 in which said fluid additionally comprises particles of fumed silica.

11. A fluid as recited in claim 9 in which said fluid additionally comprises particles of fumed silica.

12. A magnetorheological fluid comprising low coercivity, generally spherical magnetic particles dispersed in a liquid vehicle, said particles consisting essentially of a first group of surfactant coated carbonyl iron particles having a first range of diameter sizes with a first mean diameter having a standard deviation no greater than about two-thirds of the value of said first mean diameter and a second group of particles with a second range of diameter sizes and a second mean diameter having a standard deviation no greater than about two-thirds of said second mean diameter, such that the major portion of all particle sizes fall within the range of one to 100 microns and the weight ratio of each of said first group and said second group to the total weight of said magnetic particles is in the range of 0.1 to 0.9, and the ratio of said first mean diameter to said second mean diameter is five to ten, said liquid vehicle comprising at least one liquid selected from the group consisting of a polyalphaolefin, an alkyl ester of a tall oil fatty acid, and dioctyl sebacate, and said fluid additionally comprising dispersed fumed silica.

* * * * *